US007693475B2

(12) United States Patent
Shakuto et al.

(10) Patent No.: US 7,693,475 B2
(45) Date of Patent: Apr. 6, 2010

(54) LUBRICANT SUPPLYING DEVICE, CLEANING DEVICE, PROCESS CARTRIDGE, AND IMAGE FORMING APPARATUS

(75) Inventors: Masahiko Shakuto, Kanagawa (JP); Akira Fujimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

(21) Appl. No.: 11/733,405

(22) Filed: Apr. 10, 2007

(65) Prior Publication Data

US 2007/0258743 A1 Nov. 8, 2007

(30) Foreign Application Priority Data

Apr. 20, 2006 (JP) ..... 2006-116619
Jun. 27, 2006 (JP) ..... 2006-176121

(51) Int. Cl.
*G03G 21/00* (2006.01)

(52) U.S. Cl. ..... 399/346

(58) Field of Classification Search ..... 399/346, 399/353, 349

See application file for complete search history.

(56) References Cited

U.S. PATENT DOCUMENTS 7,035,582 B2 * 4/2006 Suda et al. ..... 399/346
7,209,699 B2 * 4/2007 Yamaguchi et al. ..... 399/346
7,343,132 B2 * 3/2008 Kimura et al. ..... 399/346
2004/0091276 A1 * 5/2004 Yoshida et al.
2006/0045571 A1 * 3/2006 Matsuura et al.

FOREIGN PATENT DOCUMENTS

| | | | |
|---|---|---|---|
| JP | 54-60933 | | 5/1979 |
| JP | 59-147373 | | 8/1984 |
| JP | 59147373 | A * | 8/1984 |
| JP | 63-223772 | | 9/1988 |
| JP | 11-65311 | | 3/1999 |
| JP | 2000330425 | A * | 11/2000 |
| JP | 2002323837 | A * | 11/2002 |
| JP | 2004-109869 | | 4/2004 |
| JP | 2001-228668 | | 8/2004 |
| JP | 2005-70276 | | 3/2005 |
| JP | 2005091692 | A * | 4/2005 |
| JP | 2005-121760 | | 5/2005 |
| JP | 2005-227676 | | 8/2005 |
| JP | 2006-30430 | | 2/2006 |
| JP | 3816313 | | 6/2006 |

OTHER PUBLICATIONS

U.S. Appl. No. 12/019,317, filed Jan. 24, 2008, Fujimori.

* cited by examiner

*Primary Examiner*—Susan S Lee
(74) *Attorney, Agent, or Firm*—Oblon, Spivak, McClelland, Maier & Neustadt, L.L.P.

(57) ABSTRACT

A lubricant supplying device that supplies lubricant onto a surface of an image carrier includes a lubricant carrying unit and a transfer unit. The lubricant carrying unit faces the image carrier in a non-contact manner, and carries the lubricant. The transfer unit transfers the lubricant from the carrying unit onto the image carrier.

18 Claims, 11 Drawing Sheets

LUBRICANT SUPPLYING DEVICE, CLEANING DEVICE, PROCESS CARTRIDGE, AND IMAGE FORMING APPARATUS

CROSS-REFERENCE TO RELATED APPLICATIONS

The present document incorporates by reference the entire contents of Japanese priority document, 2006-116619 filed in Japan on Apr. 20, 2006 and 2006-176121 filed in Japan on Jun. 27, 2006.

BACKGROUND OF THE INVENTION

1. Field of the Invention

The present invention relates to a lubricant supplying device, a cleaning device, a process cartridge, and an image forming apparatus.

2. Description of the Related Art

In an electrophotographic image forming apparatus, such as a copier, a printer, a facsimile machine, and a multifunctional product (MFP) using a combination thereof, a lubricant supplying device (lubricant applicator) has been employed. The lubricant supplying device supplies (applies) lubricant to an image carrier to reliably remove attachments such as non-transferred toner on the image carrier such as a photosensitive drum by a cleaning device and reduce abrasion of the image carrier and a cleaning blade. For example, Japanese Patent Application Laid-Open No. 2002-62737 discloses such a technology.

Specifically, all of the non-transferred toner left on the image carrier after a transferring process have to be removed by the cleaning blade (cleaning device) abutting on the image carrier. However, when the cleaning blade is deteriorated (abraded) with time due to the abutment on the image carrier, the non-transferred toner may go through a gap between the abraded cleaning blade and the image carrier to cause defective cleaning. Even if the cleaning blade has not yet been deteriorated, when a small-particle-diameter toner or spherical toner is used, the toner may enter and then go through a slight gap between the cleaning blade and the image carrier to cause defective cleaning. Furthermore, when the toner and the attachments, such as an external additive included in the toner and paper powder, go through the gap between the cleaning blade and the image carrier, they may be fixed on the image carrier in a film shape to cause filming.

To overcome these problems, lubricant is applied to the image carrier. With this, a coefficient of friction on the image carrier is decreased to reduce deterioration of the cleaning blade and the image carrier. Also, the capability of detachment of attachments, such as non-transferred toner, from the image carrier is increased, thereby preventing the occurrence of defective cleaning and filming due to changes with time.

Specifically, in the above conventional technology, for example, the lubricant supplying device includes a brush-shaped rotating member (brush member), a solid lubricant abutting on the brush-shaped rotating member, a spring that presses the brush-shaped rotating member onto the fixed lubricant, and others. Being gradually scraped off the solid lubricant by the brush-shaped rotating member rotating in a predetermined direction, lubricant scraped off by the brush-shaped rotating member is applied to the surface of the image carrier.

On the other hand, for example, Japanese Patent Application Laid-Open No. 2005-70276 discloses a lubricant supplying device with a container accommodating lubricant being disposed near an image carrier and a technology of directly supplying the lubricant accommodated in the container to the image carrier.

Besides, for example, Japanese Patent Application Laid-Open No. H11-65311 discloses a technology in which a lubricant supplying device is provided above an image carrier to supply lubricant onto the surface of the image carrier through a free-falling of the lubricant scraped by a brush-shaped rotating member.

In the conventional technology disclosed in Japanese Patent Application Laid-Open No. 2002-62737, the brush-shaped rotating member directly abuts the image carrier. Thus, a flaw tends to occur on the surface of the image carrier, and it is difficult to increase the life of the image carrier.

In contrast, in the conventional technology disclosed in Japanese Patent Application Laid-Open No. 2005-70276, no brush-shaped member is provided, and the lubricant accommodated in the container is directly supplied. Thus, a flaw tends not to occur on the surface of the image carrier. However, a large amount of lubricant is always in contact with the image carrier, the lubricant may possibly be excessively supplied to the image carrier more than a required amount.

In the conventional technology disclosed in Japanese Patent Application Laid-Open No. H11-65311, a bush-shaped rotating member is distanced from the image carrier. Thus, a flow tends not to occur on the surface of the image carrier. However, the lubricant scraped by the brush-shaped rotating is let freely fall to be supplied onto the surface of the image carrier. Therefore, the lubricant may be supplied only to a part of the surface of the image carrier to cause unevenness in supplying the lubricant. Moreover, in such a technology of supplying the lubricant onto the image carrier by free-falling, it is difficult to control the amount of supply of the lubricant to be supplied onto the image carrier and its supply timing. Specifically, even when the lubricant is not desired to be supplied onto the image carrier, the lubricant may be supplied onto the image carrier by free-falling. Furthermore, since the configuration is such that the lubricant is supplied onto the image carrier by free-falling, the lubricant supplying device has to be disposed above the image carrier. Therefore, the restriction by the layout of the image forming apparatus is significant.

SUMMARY OF THE INVENTION

It is an object of the present invention to at least partially solve the problems in the conventional technology.

According to an aspect of the present invention, a lubricant supplying device that supplies lubricant onto an image carrier includes a carrying unit that faces the image carrier in a non-contact manner and carries the lubricant, and a transfer unit that transfers the lubricant from the carrying unit onto the image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
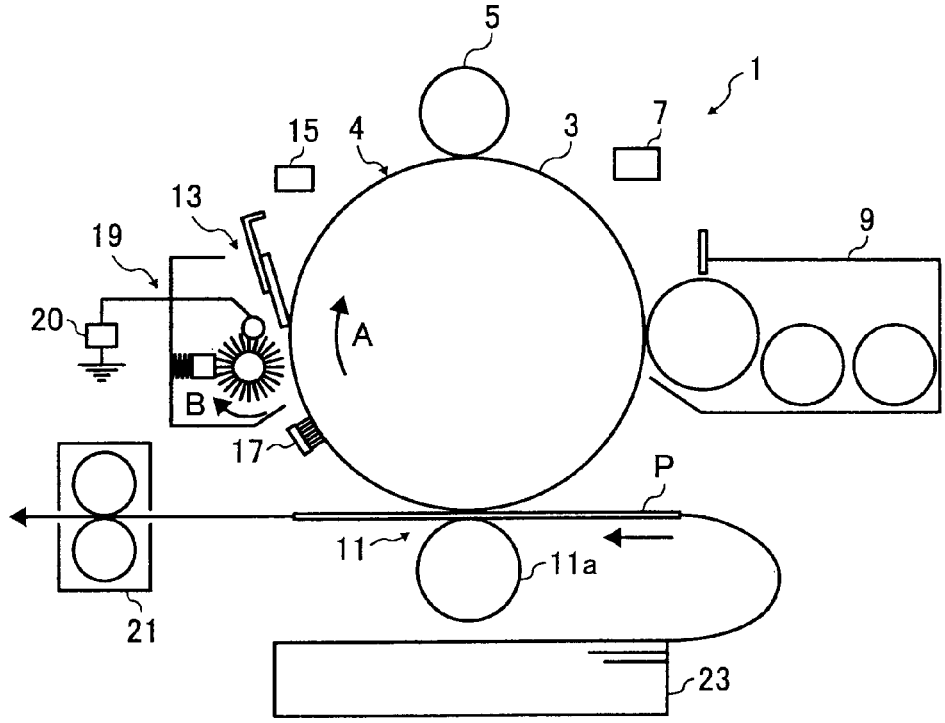
FIG. 1 is a schematic of an image forming apparatus according to a first embodiment of the present invention.

Exemplary embodiments of the present invention are explained in detail below with reference to the accompanying drawings. Like reference characters refer to corresponding parts throughout the drawings, and the same explanation is not repeated.

In the following description, a "process cartridge" is defined as a unit that includes an image carrier integrally formed with at least one of a charging device (charging unit) that charges the image carrier, a developing device (developing unit) that develops a latent image formed on the image carrier, and a cleaning device (cleaning unit) that cleans a surface of the image carrier, and removably mounted on an image forming apparatus. The expression "lubricant is transferred onto the image carrier" indicates that the lubricant is mechanically or electrically transferred onto the image carrier and does not mean that the lubricant drops onto the image carrier by self-weight.

With reference to FIGS. 1 to 4, a first embodiment of the present invention is explained in detail. First, the configuration and operation of an image forming apparatus 1 is explained with reference to FIG. 1.

The image forming apparatus 1 is a monochrome image forming apparatus, and includes a photosensitive drum (image carrier) 3, a charging device (charging unit) 5, an exposing device 7, a developing device 9, a transferring device 11, a cleaning blade (cleaning device) 13, a static eliminating device (static eliminating unit) 15, a lubricant supplying device (lubricant applicator) 19, and a conductive brush 17. The photosensitive drum 3 serves as an image carrier and carries an electrostatic latent image and rotates in a direction indicated by an arrow A in FIG. 1. The charging device 5 charges a surface 4 of the photosensitive drum 3. The exposing device 7 exposes the surface 4 to light to form an electrostatic latent image. The developing device 9 supplies toner to the electrostatic latent image on the surface 4 for visualization. The transferring device 11 transfers a toner image on the surface 4 onto a transfer member P. The cleaning blade 13 cleans the surface 4 after transfer. The static eliminating device 15 removes residual charges on the surface 4. The lubricant supplying device 19 applies lubricant 25 to the photosensitive drum 3. The conductive brush 17 serves as a surface potential equalizing unit and equalizes the surface potential of the photosensitive drum 3.

On a downstream side of a transfer member conveying direction (indicated by an arrow) of the transferring device 11, a fixing device 21 that fixes a toner image on the transfer member P is disposed. On an upstream side of a transfer member conveying direction of the transferring device 11, a paper-feeding device 23 is disposed.

The photosensitive drum 3 is formed with a photosensitive layer formed of an organic photoreceptor on an outer perimeter of an aluminum base, and its drum surface layer is formed of polycarbonate.

The charging device 5 uniformly charges the surface 4 of the photosensitive drum 3. The charging device 5 (charging roller) can be disposed in contact with the surface of the photosensitive drum 3, or can be disposed with a subtle space with respect to the surface of the photosensitive drum 3. A charging bias is applied to the charging device 5 to uniformly charge the surface of the photosensitive drum 3 so that the surface has a desired polarity at a desired potential. As the charging device 5, in addition to a charging roller formed of an elastic body, a scorotron charger using a wire electrode and a grid electrode may be used, for example.

The exposing device 7 forms according to image data an electrostatic latent image on the surface of the photosensitive drum 3 charged by the charging device 5. This exposing device uses, for example, a laser diode (LD) or a light emitting diode (LED), as a light-emitting element. With light based on the image data emitted onto the uniformly-charged photosensitive drum 3, an electrostatic latent image is formed on the surface of the photosensitive drum 3.

The developing device 9 causes toner to be attached onto the electrostatic latent image formed on the surface of the photosensitive drum 3 for development. The developing device 9 includes developing rollers made of magnets as developer carriers. The developing rollers rotate as carrying a developer on the surface, thereby conveying the developer to a developing area opposed to the photosensitive drum 3. In the first embodiment, two-component developer formed of a toner and carriers is used as a developer, and a magnetic-brush development scheme is adopted in which a magnetic force of the magnet rollers cause carriers to be erected in a brush shape for development. As the developer, a one-component developer made of only a toner without using carriers may be used. The developing rollers are applied with a developing bias from a developing bias power supply. With this, a potential difference occurs in the developing area between the potential of the surface of the developing rollers and the potential of the electrostatic latent image portion on the surface of the photosensitive drum 3. Upon reception of an operation of a developing electric field formed due to this potential difference, the toner in the developer is attached to the electrostatic latent image. With this, the electrostatic latent image on the photosensitive drum 3 becomes a toner image.

The transferring device 11 transfers the toner image on the photosensitive drum 3 onto the transfer member P conveyed in the direction indicated by the arrow. At the transferring device 11, a transfer roller 11*a*, which is a transferring member, is made contact with the surface 4 of the photosensitive drum 3 with a predetermined pressure force to form a transfer nip between the transfer roller 11*a* and the photosensitive drum 3. Then, with the transfer member P being nipped with this transfer nip, a transfer bias with a polarity opposite to that of the toner is applied from the transfer bias power supply to the transfer roller 11*a*, thereby forming a transfer electric field. With this transfer electric field, the toner image on the surface of the photosensitive drum 3 is transferred onto the transfer member P. As the transfer member, in addition to the transfer roller 11*a*, a transfer belt can be used. Instead of having a configuration in which a transfer is made directly from the transfer roller 11*a* onto the transfer member P, the transferring device 11 may have a configuration using an intermediate transfer belt in which a plurality of toner images are superposed each other on the transfer member and then a transfer is made onto the transfer member P.

The cleaning blade 13 removes, from the surface of the photosensitive drum 3, transfer residual toner that is left untransferred on the surface of the photosensitive drum 3. The cleaning blade 13 is formed by laminating a blade member made of polyurethane onto a metal supporting member, and is caused to be in contact with the photosensitive drum 3 in a counter direction with respect to the rotating direction A of the photosensitive drum 3. The cleaning blade 13 removes from the photosensitive drum 3 not only the toner on the surface of the photosensitive drum 3 but also paper powder occurring when a paper sheet is used as a transfer member P, discharge products generated through an electric discharge from the photosensitive drum 3, and impurities, such as additives added to the toner.

The static eliminating unit 15 eliminates a residual charge on the surface of the photosensitive drum 3. With this, on the surface of the photosensitive drum 3 with the residual charge eliminated, the next image formation is performed. The static eliminating unit 15 adopts an optical static eliminating scheme using an LED or the like, but this is not meant to be restrictive.

In the first embodiment, a spherical toner with a peround of 0.98 or larger is used as a toner. The "peround" is an average peround measured by a flow particle image analyzer FPIA-200 (from Toa Medical Electronics). Specifically, 0.1 milliliters to 0.5 milliliters of a surface active agent, preferably alkyl benzene sulfonate, as a dispersant is added to 100 milliliters to 150 milliliters of water with impurity solid matters removed in advance in a container, and then approximately 0.1 grams to 0.5 grams of a measurement sample (toner) is further added. Then, this suspension with the toner being dispersed is subjected to a dispersion process for approximately one minute to three minutes in a ultrasonic distributor so that the condensation of this dispersion becomes 3000 per microliter to 10000 per microliter. This dispersion is set on the analyzer mentioned above to measure the shape and distribution of the toner. As the spherical toner, a odd-form toner in a distorted shape (crushed toner) is used that is formed through a crushing scheme conventionally widely used and then subjected to a heat treatment or the like to be made spherical, or a toner manufactured through a polymerization method is used, for example.

Figure 2:
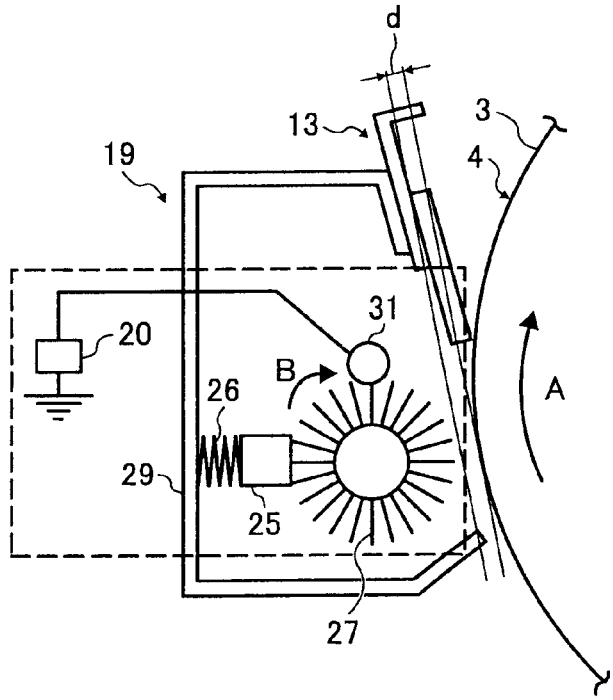
FIG. 2 is an enlarged view of a lubricant supplying device shown in FIG. 1.

Next, the lubricant supplying device 19 is explained referring to FIG. 2. As shown in FIG. 2, the lubricant supplying device 19 is internally provided in the cleaning device in which the cleaning blade 13 is placed. The lubricant supplying device 19 includes the solid-shaped lubricant 25 (solid lubricant), a brush-shaped rotating member 27 (brush member, lubricant applying unit) as a lubricant carrying unit that carries the lubricant 25, and others.

The brush-shaped rotating member 27 is surrounded by conductive bristles of brush (fiber bristles of brush) and is opposed to the photosensitive drum 3 in a non-contact manner. The brush-shaped rotating member 27 is mounted to make contact with the lubricant 25 and is rotated to scrape the lubricant 25. At this time, the powder lubricant 25 is attached to and carried on the surface of the fiber bristles of brush forming the brush-shaped rotating member 27. The lubricant 25 is fixed to a supporting member 29 via a spring 26, which keeps the lubricant 25 pressed onto the brush-shaped rotating member 27. With the solid lubricant 25 being pressed onto the brush-shaped rotating member 27, a contact unevenness between the brush-shaped rotating member 27 and the lubricant 25 can be eliminated.

The bristles of brush of the brush-shaped rotating member 27 are conductive fibers made of resin fibers such as nylon, rayon, acryl, vinylon, polyester, or polyvinyl mixed with a conductivity providing agent such as carbon. Also, the bristles of brush preferably have a brush density of 0.01 million per square inch to 0.5 million per square inch and a brush resistance of $10^{-2}$ Ω·cm to $10^{-12}$ Ω·cm. In the first embodiment, the one having a brush length of 5 millimeters, a brush density of 0.1 million per square inch, and a brush resistance of $10^{5}$ Ω·cm is used.

In the first embodiment, the brush-shaped rotating member 27 is arranged to have a gap "d" with the photosensitive drum 3. With this, damages of the bristles of the brush-shaped rotating member 27 on the photosensitive drum 3 are reduced. The brush-shaped rotating member 27 rotates in a direction indicated by an arrow B, which is the same rotating direction as that of the photosensitive drum 3; however, the rotation can be in a reversed direction.

The brush-shaped rotating member 27 is configured by winding bristles of brush implanted on a base cloth in a spiral manner around a core wire made of metal, the bristles of brush having a length in a range of 0.2 millimeters to 20 millimeters, preferably 0.5 millimeters to 10 millimeters. If the length of the bristles of brush is longer than 20 millimeters, repeated sliding friction of the brush-shaped rotating member 27 with the lubricant 25 decreases a tilt angle in a reversed direction of a brush body to cause the bristles to fall down, thereby decreasing the capability of scraping the lubricant 25. If the length of the bristles of brush is shorter than 0.2 millimeters, the length of bristles of brush is so short that it is difficult for the bristles of brush to make contact with the lubricant 25, which makes it impossible to scrape the lubricant 25. Therefore, the range is preferably 0.2 millimeters to 20 millimeters, more preferably 0.5 millimeters to 10 millimeters.

In the lubricant supplying device 19, an electrode 31 (polarity providing member or charge providing unit) that provides charges onto the powder lubricant 25 carried on the brush-shaped rotating member 27 is arranged to make contact with the bristles of brush. The electrode 31 is connected to a power supply 20 that applies a voltage to the electrode 31 to provide a desired charge to the lubricant 25 and the brush-shaped rotating member 27.

As for a positional relation between the electrode 31 and the brush-shaped rotating member 27, if the contact width is small, it is difficult to provide a polarity the brush-shaped rotating member 27. However, if the contact width is large, although a polarity can be enough provided to the brush-shaped rotating member 27, the bristles of the brush-shaped rotating member 27 are fell to decrease a brushing function. Therefore, a contact width between the electrode 31 and the brush-shaped rotating member 27 is preferably 0.1 millimeters to 2.0 millimeters.

With a direct-current voltage being applied to the brush-shaped rotating member 27, a charge is injected to the brush-shaped rotating member 27 to form a desired electric field (in the gap "d") between the brush-shaped rotating member 27 and the photosensitive drum 3. Also, a charge is injected to the powder lubricant 25 carried on the brush-shaped rotating member 27. With this, the lubricant carried on the brush-shaped rotating member 27 is transferred (supplied) to the surface 4 of the photosensitive drum 3. That is, the electrode 31 and the power supply 20, for example, serve as transfer units that electrically transfer the lubricant carried on the brush-shaped rotating member 27 onto the photosensitive drum 3. A superposed voltage of alternating and direct voltages may be applied to the brush-shaped rotating member 27.

In the first embodiment, the brush-shaped rotating member 27 as a lubricant carrying unit is disposed at a position where the carried lubricant does not drop onto the photosensitive drum 3 by self weight. With this, inconveniences can be prevented such that the lubricant carried on the brush-shaped rotating member 27 drops onto the photosensitive drum 3 by self weight, thereby causing an excessive lubricant supplied to the photosensitive drum 3 or evenness in supplying the lubricant.

Figure 3:
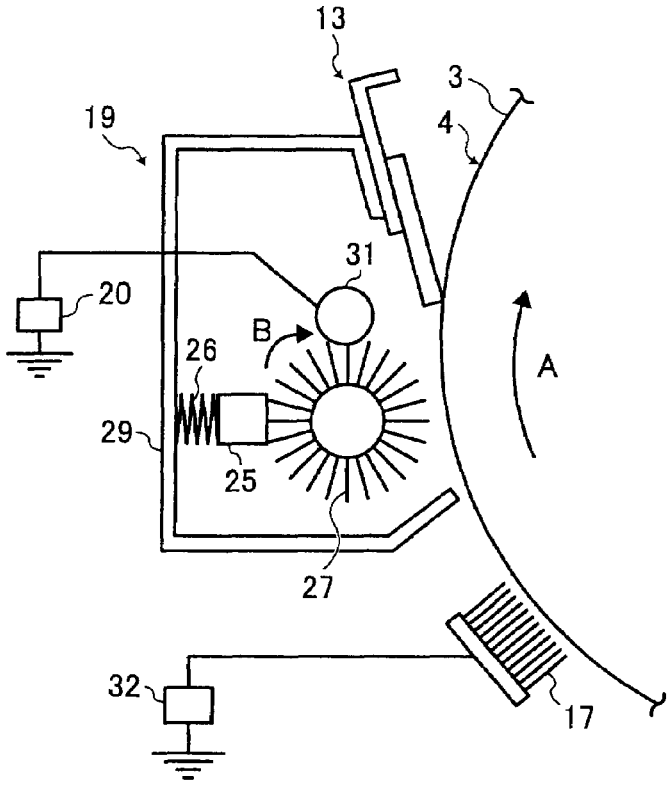
FIG. 3 is an enlarged view of a portion near a conductive brush shown in FIG. 1.

Next, with reference to FIG. 3, a surface potential equalizing unit that equalizes the surface potential of the photosensitive drum 3 after transfer is explained.

The brush-shaped rotating member 27 charged by the electrode 31 forms an electric field in the gap "d" with the surface of the photosensitive drum 3. In that field, the charged powder lubricant 25 flies from the brush-shaped rotating member 27 onto the surface of the photosensitive drum 3 for attachment.

In the transferring device 11, to transfer the toner onto the transfer member P in an electrostatically manner, a voltage with a polarity in reverse to the polarity of the toner is applied. Therefore, the surface potential on the photosensitive drum 3 receives an effect of a transfer current and has a mixture of negative potentials and positive potentials according to the presence or absence of the developed toner image. With this surface potential of the photosensitive drum 3 as it is, a uniform electric field cannot be formed between the brush-shaped rotating member 27 and the photosensitive drum 3. Therefore, in the first embodiment, the conductive brush 17 is located upstream, in a rotating direction (moving direction) of the photosensitive drum 3, from the brush-shaped rotating member 27 as a surface potential equalizing unit that equalizes the surface potential of the photosensitive drum 3. That is, before forming an electric field and supplying the lubricant 25 onto the surface of the photosensitive drum 3, the surface potential of the photosensitive drum 3 is equalized. With this, a uniform electric field is formed between the brush-shaped rotating member 27 and the photosensitive drum 3 to stably and uniformly supply the lubricant onto the photosensitive drum 3.

The conductive brush 17 slidably contacts the photosensitive drum 3 and has connected thereto a power supply 32 that applies thereto a predetermined voltage. The conductive brush 17 preferably has a brush length of 1 millimeter to 10 millimeters, a brush density of 0.01 million per square inch to 0.5 million per square inch, and a brush resistance of $10^{-2}$ Ω·cm to $10^{12}$ Ω·cm. In the first embodiment, the one having a brush length of 5 millimeters, a brush density of 0.1 million per square inch, and a brush resistance of $10^{5}$ Ω·cm is used. It is also assumed that the amount of engagement of the bristles of brush with the photosensitive drum 3 is 1 millimeter.

To the conductive brush 17, a bias voltage of −400 volts to −800 volts is applied by the direct constant voltage power supply 32 to charge the photosensitive drum 3. As an applied voltage, a superposed voltage of alternating and direct voltages may be applied. When the surface potential of the photosensitive drum 3 is −600 volts, a charge is injected via the electrode 31 so that surface potential of the brush-shaped rotating member 27 of the lubricant supplying device 19 is −600 volts to −800 volts. With this, a charge is injected even to the powder lubricant 25 held on the brush-shaped rotating member 27. With the action of the electric field formed in the gap "d" between the photosensitive drum 3 and the brush-shaped rotating member 27, the lubricant 25 flies onto the photosensitive drum 3 for attachment.

In the first embodiment, the power supply 20 and the electrode 31 are controlled to transfer the lubricant onto the photosensitive drum 3 while the photosensitive drum 3 is being driven. That is, the lubricant supplying device 19 always supplies the lubricant 25 at the time of driving of the photosensitive drum 3. With the lubricant 25 continued to be supplied onto the photosensitive drum 3, the lubricant can be sufficiently supplied to the surface of the photosensitive drum 3, which prevents deterioration in cleaning due to shortage of the amount of supply. Also, since the lubricant can be sufficiently supplied to the surface of the photosensitive drum 3, a situation can be prevented such that the film thickness of the surface of the photosensitive drum 3 is decreased due to a discharge from the charging device 5.

In the first embodiment, the lubricant 25 provided with the potential due to a potential difference between the photosensitive drum 3 and the brush-shaped rotating member 27 is caused to fly onto the photosensitive drum 3 for application. Therefore, the lubricant 25 can be uniformly applied to the surface of the photosensitive drum 3. In other words, the lubricant 25 can be applied to the surface of the photosensitive drum 3 without unevenness.

By varying the set values of the power supply 32 that controls the surface potential of the photosensitive drum 3 after transfer and the power supply 20 that controls the voltage of the brush-shaped rotating member 27 to control the strength of the electric field between the photosensitive drum 3 and the brush-shaped rotating member 27, the amount of supplying the lubricant 25 can be controlled.

Figure 4:
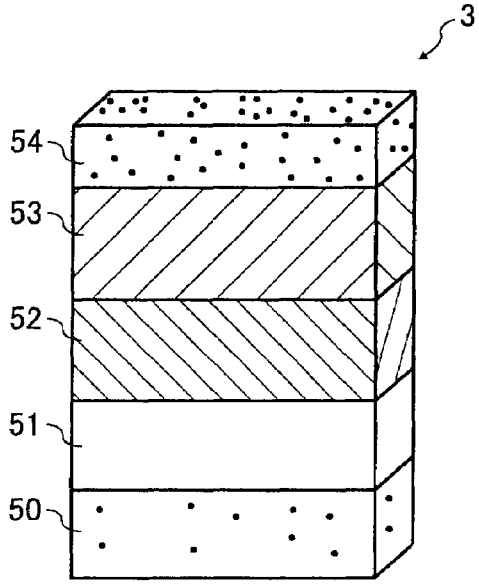
FIG. 4 is a schematic of a photosensitive drum shown in FIG. 1.

Next, with reference to FIG. 4, the configuration of the photosensitive drum 3 is explained.

The photosensitive drum 3 is a negatively-charged organic photoreceptor, and is configured such that a photosensitive layer or the like is provided on a drum-shaped conductive supporting member. As shown in FIG. 4, in the photosensitive drum 3, a conductive supporting member 50 as a base layer has provided thereabove an under layer 51 as an insulating layer, above which a charge generating layer 52 and a charge conveying layer 53 are provided as photosensitive layers. The charge conveying layer 53 has laminated thereabove a protective layer 54 that prevents mechanical abrasion.

As the conductive supporting member 50, a conductive material having a volume resistivity equal to or lower than $10^{10}$ Ω·cm is used. The photosensitive layer includes the charge generating layer 52 and the charge conveying layer 53. The charge generating layer 52 is a layer with a charge generating material as the main ingredient. For the charge generating layer, a known charge generating material can be used, typified by a monoazo pigment, disazo pigment, trisazo pigment, perylene-series pigment, perynone-series pigment, quinacridon-series pigment, quinone-series condensation polycyclic compound, squaric-acid-series pigment, phthalocyanine-series pigment, naphthalocyanine-series pigment, azlenium-salt-series pigment, and others. These charge generating materials may be used singly or in combination of two or more.

The charge generating layer 52 is formed by dispersing a charge generating material, with binding resin as required, in an appropriate solvent by using a ball mill, attritor, sand mill, ultrasonics, or others, applying the result to the conductive supporting member or the under layer 51, and then drying the result. Examples of a liquid applying scheme include an immersion applying scheme, spray coating, beat coating, spinner coating, and ring coating. The film thickness of the charge generating layer 52 is approximately 0.01 micrometers to 5 micrometers, preferably 0.1 micrometers to 2 micrometers.

The charge conveying layer 53 is formed by dissolving or dispersing a charge conveying material and binding resin in an appropriate solvent, applying the result to the charge generating layer 52, and then drying the result. As required, single or two or more of plasticizers, leveling agents, and antioxidants may be added. The amount of the charge conveying material is 20 parts by weight to 300 parts by weight, preferably 40 parts by weight to 150 parts by weight with respect to 100 parts by weight of the binding resin. The film thickness of the charge conveying layer is preferably equal to or smaller than 25 micrometers in view of resolution and responsiveness. The film thickness of the charge conveying layer varies depending on the system for use (in particular, charge potential), but is preferably equal to or larger than 5 micrometers.

Next, the case where the photosensitive layer is configured by a single layer is explained. The photosensitive layer is formed by dissolving or dispersing a charge generating material, a charge conveying material, binding resin, and others explained above in a solvent, applying the result to the conductive supporting member 50 or the under layer 51, and then drying the result. The photosensitive layer may be configured only of the charge generating material and binding resin without including a charge conveying material. Also, as required, a plasticizer, leveling agent, antioxidant, or others may be added. Examples of binding resin may include those listed in the explanation of the charge conveying layer 53 as well as a mixture of those listed in the explanation of the charge generating layer 52. Also, a high-polymer charge conveying material as explained above may be mixed. The amount of charge generating material with respect to 100 parts by weight of the binding resin is preferably 5 parts by weight to 40 parts by weight. The amount of charge conveying material is preferably 0 part by weight to 190 parts by weight, more preferably 50 to 150 parts by weight.

The photosensitive layer is formed by dispersing a charge generating material and binding resin with a charge conveying material by using menstruum, such as tetrahydrofuran, dioxane, dichloroethane, or cyclohexane, by a distributor or the like, to obtain a coating liquid, and then applying the coating liquid through an immersion applying scheme, spray coating, beat coating, ring coating, or others. The film thickness of the photosensitive layer is preferably 5 micrometers to 25 micrometers.

The under layer 51 has resin as the main ingredient. However, in consideration of applying the photosensitive layer to the resin with a solvent, the resin is desirably the one with a solvent-resistance higher than that of general organic solvents. Examples of such resin include water-soluble resins such as polyvinyl alcohol, casein, and sodium polyacrylate; alcohol-soluble resins such as copolymer nylon, methoxymethylate nylon; curing resins forming a three-dimensional network such as polyuretane, melamine resin, phenol resin, alkyd-melamine resin, and epoxy resin. To prevent moire and reduction in residual potential, for example, a fine-powder pigment made of metal oxide exemplified by titanium oxide, silica, alumina, zirconium oxide, tin oxide, or indium oxide can be added to the under layer 51. As with the photosensitive layer, the under layer 51 is formed by using an appropriate solvent and coating scheme. The under layer 51 can be the one obtained through anodic oxidation of Al203 such as silane coupling agent, titanium coupling agent, or chromium coupling agent; an organic substance such as polyparaxylylene (parylene); or the one obtained from an inorganic substance such as $SiO_2$, $SnO_2$, $TiO_2$, ITO, or $CeO_2$, through a vacuum film-thinning scheme. The film thickness of the under layer 51 is preferably 0 micrometer to 5 micrometers.

The protective layer (surface protective layer) as a surface layer may be implemented by using the one having a cross-linking structure as a binder structure. In the cross-linking structure, a reactive monomer having a plurality of cross-linking functional groups in one molecule is used to cause a cross-linking reaction to form a three-dimensional network. With this network functioning as binder resin, abrasion resistance is increased. By using a monomer all or part of which includes a charge conveying capability is used as a reactive monomer, the protective layer 54 can have electric stability, high abrasion resistance, and long life. Examples of such a reactive monomer with a charge conveying capability include a compound containing at least one or more charge conveying components and at least one or more arsenic atoms with a hydrolyzable substituent in the same molecule, a compound containing a charge conveying component and a hydroxyl group in the same molecule, a compound containing a charge conveying component and a carboxyl group in the same molecule, a compound containing a charge conveying component and an epoxy group in the same molecule, a compound containing a charge conveying component and an isocyanate group in the same molecule, and others. These charge conveying materials with a reactive group may be used singly or in combination of two or more. More preferably, as a monomer with a charge conveying capability, a reactive monomer having a triarylamine structure may be used because of a high electric and chemical stability and fast carrier mobility. Also, for the purpose of adjustment in viscosity at the time of coating, mitigation of stress of the cross-linking charge conveying layer, decrease in energy and friction of coefficient on the surface, and others, known one-function or two-function polymerized monomer or polymerized oligomer may be used.

In the first embodiment, a positive-hole conveying compound is polymerized or cross-linked by using heat or light. For a polymerization reaction by heat, there may be a case where a polymerization reaction proceeds only with thermal energy or a case where a polymerization initiator is required. To cause a reaction to efficiently proceed at a lower temperature, addition of a polymerization initiator is preferable. For polymerization by light, ultraviolet rays are preferably used. However, it is very rare that the reaction proceeds only with light energy. In general, a light polymerization initiator is concurrently used. The polymerization initiator in this case starts polymerization by mainly absorbing ultraviolet rays having a wavelength equal to or shorter than 400 nanometers to generate an activated species, such as a radical or an ion. The charge conveying layer 53 of a network structure thus formed has a high abrasion resistance, but its volume shrinkage at the time of a cross-linking reaction is large. Therefore, if the film thickness is too thick, a crack or the like may occur. In such a case, for a multilayer structure, the protective layer 54 may be used, in its lower layer (on the photosensitive layer side) being implemented by a protective layer with low molecule dispersion and it upper layer (on the surface side) being implemented by a protective layer with a cross-linking structure.

In the first embodiment, a protective layer using binder resin with a cross-lining structure is provided as a surface layer of the photosensitive drum 3. With this, the hardness of the protective layer can be increased, which prevents surface-layer scraping due to the cleaning blade 13. Also, a charge conveying material is included in the binder resin, which prevents the function as a photosensitive layer from being impaired.

In the first embodiment, the lubricant 25 is always applied to the photosensitive drum 3 while the drum is being driven for rotation. This is not meant to be restrictive. Alternatively, the power supply 20 and the electrode 31 can be controlled so that the lubricant is transferred over the photosensitive drum 3 at predetermined time intervals. For example, the lubricant can be supplied onto the photosensitive drum at predetermined intervals when the photosensitive drum is being driven for rotation. In this case, a taint on the charging device 5 due to an excess of the amount of supply of the lubricant can be prevented.

The lubricant 25 is explained next. In the first embodiment, as the lubricant 25, the one with zinc stearate as the main ingredient in which lubricant oil additive is dissolved is used. Preferable lubricant is the one having a sufficient lubricating property without side effects due to an excess of supply. A lamella crystal typified by zinc stearate has a layered structure with amphipathic molecules being self-organized. When a shearing force is added, the crystal is cracked along the layers and slippery. For this reason, the lubricant 25 is applied to the surface 4 to reduce friction on the drum surface. Also, since such lubricant can uniformly cover the photosensitive drum surface upon reception of a shearing force. Therefore, the photosensitive drum surface can be effectively covered with a small amount of the lubricant 25.

Other than zinc stearate, those with a stearate group can be used, such as barium stearate, iron stearate, nickel stearate, cobalt stearate, copper stearate, strontium stearate, and calcium stearate. Similarly, other fatty acid groups can be used, such as zinc oleate, barium oleate, lead oleate, and those similar to those of stearates and zinc palmitic acid, barium palmitic acid, lead palmitic acid, and those similar to those of stearates. Furthermore, as fatty acid groups, capryl acids, linolenic acids, and colinolenic acids can be used, for example. Still further, waxes can be used, such as candelilla wax, carnauba wax, rice wax, Japan wax, jojoba oil, beeswax, and lanolin. These can be easy to use because they can be easily formed into a solid lubricant, and have an affinity for toner.

With reference to FIGS. 5 to 8, another problem in a conventional lubricant supplying device where the brush-shaped rotating member (brush member) is in contact with the photosensitive drum is explained.

Figure 5:
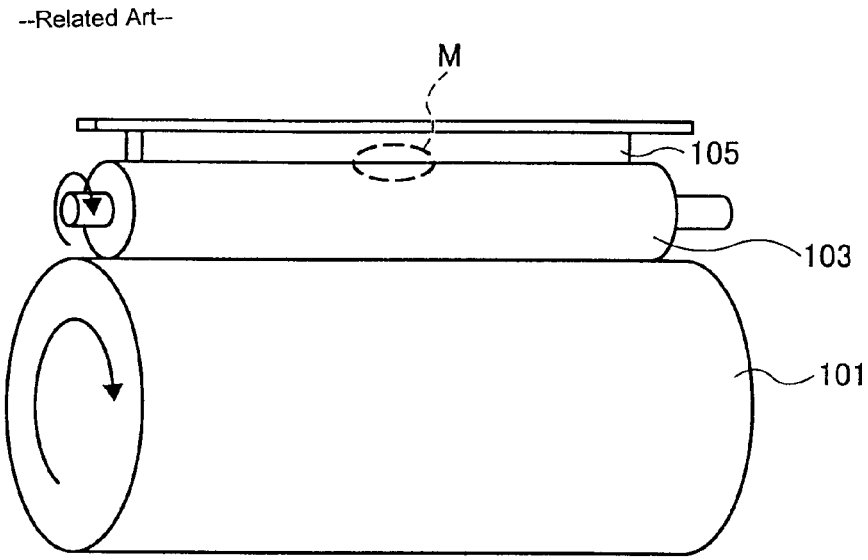
FIG. 5 is a perspective view of a conventional lubricant supplying device.
Figure 6:
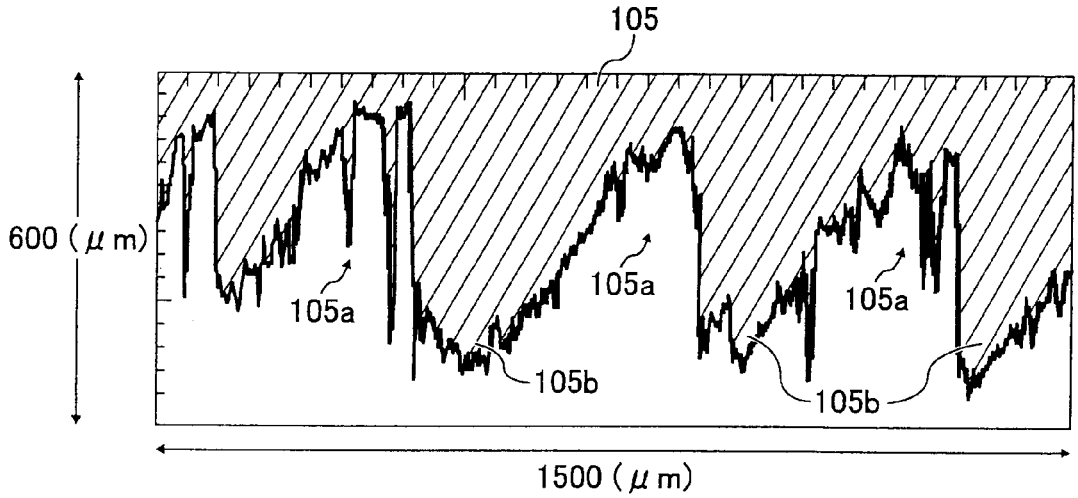
FIG. 6 is an enlarged view of a profile of an M portion of FIG. 5.
Figure 7:
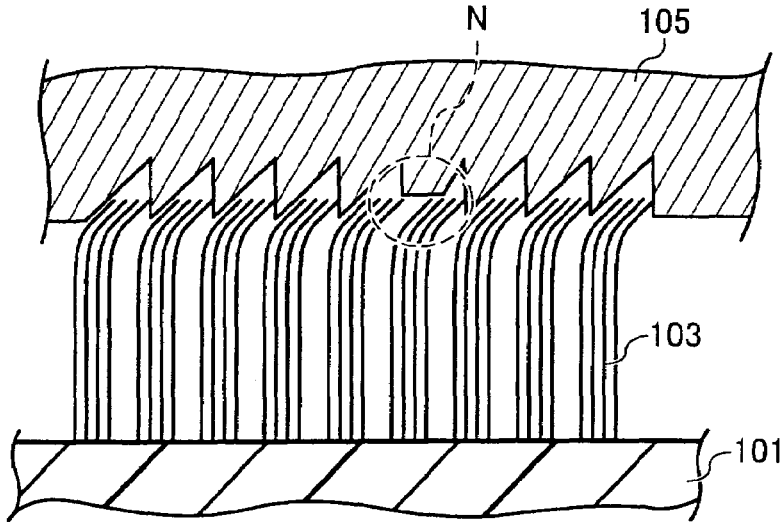
FIG. 7 is an enlarged view of a contact portion between lubricant and brush bristles of FIG. 5.
Figure 8:
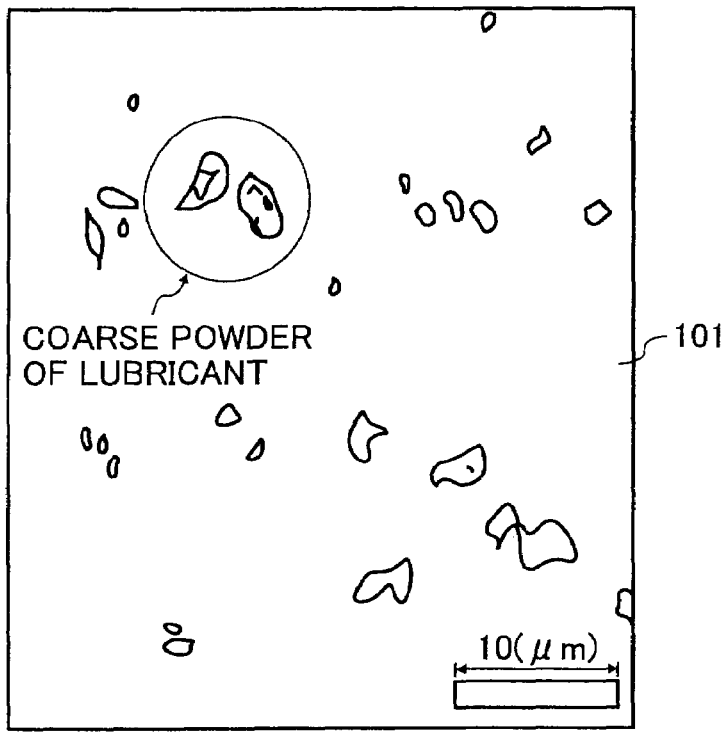
FIG. 8 is a schematic of a surface of the photosensitive drum with coarse powder of the lubricant attached thereto

FIG. 5 is a perspective view of a conventional lubricant supplying device. A solid lubricant 105 is scraped by a brush member 103 in contact with the lubricant 105, and the scraped lubricant 105 is applied to the surface of an image carrier 101 via the brush member 103. In such a configuration, brush fibers of the brush member 103 make contact with the same position on the lubricant 105. Therefore, as shown in FIG. 6 (depicting a profile of an M portion in FIG. 5) and FIG. 7 (an enlarged view of a contact portion between the lubricant and the brush bristles of FIG. 5), scratch marks by the brush bristles of the brush member 103 are made on the surface of the solid lubricant 105. On the solid lubricant 105, concave portions 105*a* scraped by the brush bristles and convex portions 105*b* left unscraped are formed. In this state, when the brush bristles are made contact with the convex portions 105*b* on the surface of the lubricant, the convex portions 105*b* are abruptly chipped (a portion indicated by "N" in FIG. 7), and a chipped chunk is attached to the brush member 103 as coarse powder, and is then attached on the surface of the image carrier 101 (refer to FIG. 8). Then, if the lubricant chunk enters a nip portion between the cleaning blade and the image carrier 101, unevenness in application of the lubricant, defective cleaning, a flaw on the image carrier may occur.

To get around this problem, in the first embodiment, the brush-shaped rotating member 27 as a lubricant carrying unit is not in contact with the photosensitive drum 3, and the lubricant carried by the brush-shaped rotating member 27 is transferred to fly onto the photosensitive drum 3 by transfer unit. A coarse chunk (coarse powder) of the lubricant tends not to fly above the photosensitive drum 3. Therefore, unevenness in supplying the lubricant, defective cleaning, a flaw on the image carrier, and other problems due to the coarse powder being attached to the photosensitive drum can be mitigated.

As explained above, according to the first embodiment, the brush-shaped rotating member 27 (lubricant carrying unit) carrying the lubricant is opposed to the photosensitive drum 3 (image carrier) in a non-contact manner, and the lubricant carried by the brush-shaped rotating member 27 is actively transferred onto the photosensitive drum 3 without using free-falling. With this, the surface of the photosensitive drum 3 tends not to suffer flaws, an appropriate amount of the lubricant can be uniformly and stably supplied onto the photosensitive drum 3, and flexibility in layout of the device can be increased.

While the first embodiment is explained taking a monochrome image forming apparatus as an example, the present invention can be applied to a color image forming apparatus having a plurality of image forming units.

Besides, in the first embodiment, the present invention is applied to a lubricant supplying device that supplies lubricant to the photosensitive drum as an image carrier. The present invention can similarly be applied to a lubricant supplying device that supplies lubricant to a photosensitive belt or an intermediate transfer belt as an image carrier.

Figure 9:
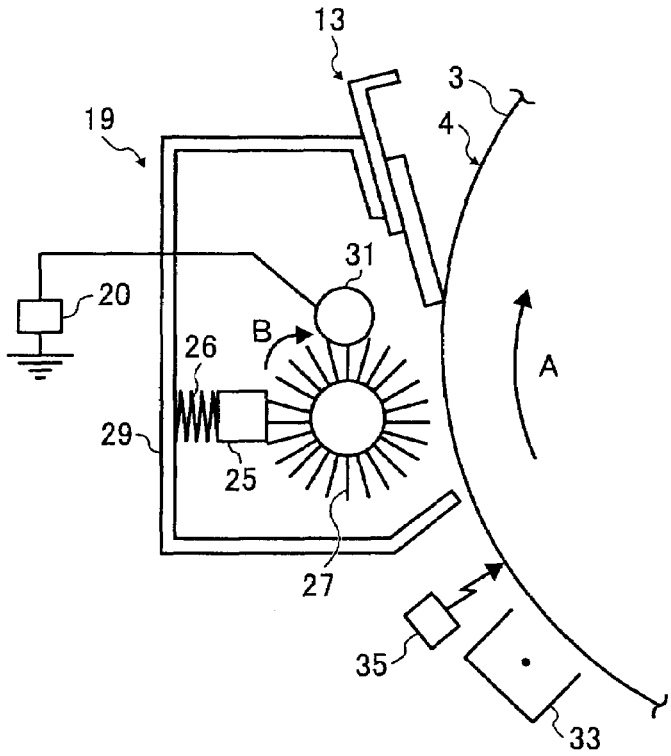
FIG. 9 is a schematic of relevant part of an image forming apparatus according to a second embodiment of the present invention.

FIG. 9 is a schematic of relevant part of an image forming apparatus according to a second embodiment of the present invention. In the second embodiment, a charging unit and a static eliminating unit are used as surface potential equalizing units differently from the first embodiment in which a conductive brush is used as a surface potential equalizing unit.

With reference to FIG. 9, the image forming apparatus includes a corotron charger 33 as a charging unit that equalizes the surface potential of the photosensitive drum 3 at a predetermined negative potential and a light emitting unit 35 as a static eliminating unit that emits static eliminating light for optical static elimination of the negatively-charged surface potential.

Under the influence of a transfer bias, potentials on the surface of the photosensitive drum 3 after transfer are uneven between an image portion (which is an area where the toner image is formed) and a non-image portion (which is an area where no toner image is formed). For example, the non-image portion has a positive potential due to a flow of a transfer current.

To get around this, the corotron charger 33 is used to change the surface potential shifted to the positive side to a negative potential, and the light emitting unit 35 emits light for static elimination so that the surface potential of the photosensitive drum 3 is near 0 volt. Here, a direct-current voltage of −6 kilovolts is applied to a corona wire in the corotron charger 33.

In the second embodiment, the surface potential of the photosensitive drum 3 is equalized before the process of applying the lubricant 25 to the photosensitive drum 3. With this, a uniform electric field can be formed between the photosensitive drum 3 and the brush-shaped rotating member 27, and the lubricant 25 can be stably applied to the surface of the photosensitive drum 3.

As explained above, according to the second embodiment, as with the first embodiment, the brush-shaped rotating member 27 carrying the lubricant is opposed to the photosensitive drum 3 in a non-contact manner, and the lubricant carried by the brush-shaped rotating member 27 is actively transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 10:
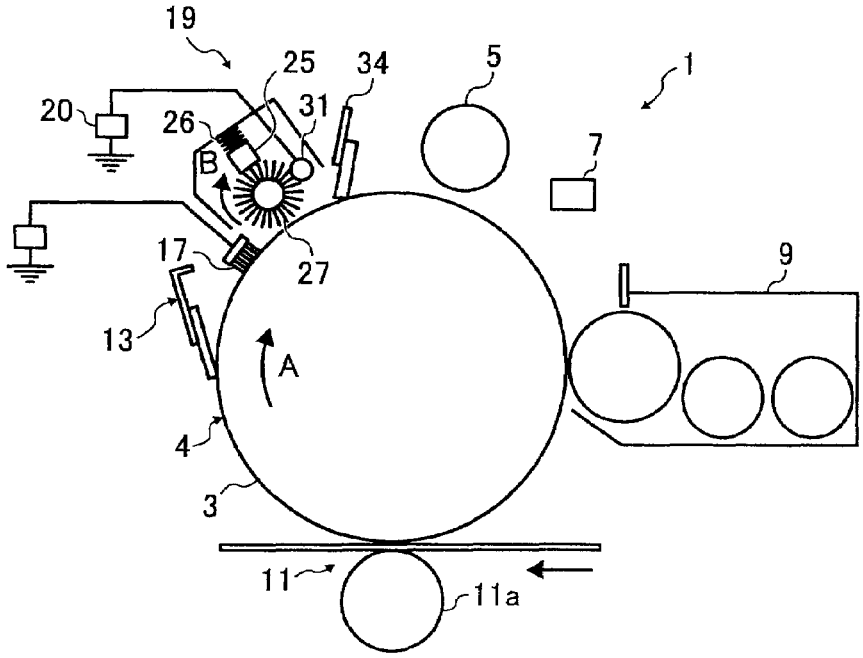
FIG. 10 is a schematic of an image forming apparatus according to a third embodiment of the present invention.
Figure 11:
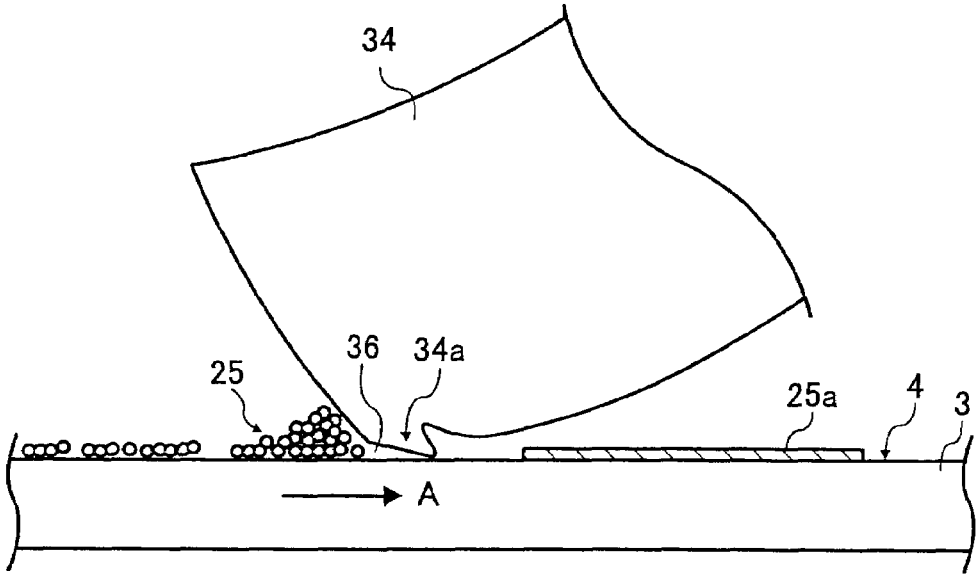
FIG. 11 is an enlarged view of a layer-thinning blade shown in FIG. 10.

FIG. 10 is a schematic of an image forming apparatus according to a third embodiment of the present invention. FIG. 11 is an enlarged view of a layer-thinning blade in a lubricant supplying device of FIG. 10. In the third embodiment, a lubricant supplying device is provided separately from a cleaning device differently from the first embodiment in which a lubricant cleaning device is internally provided in a cleaning device.

With reference to FIG. 10, the lubricant supplying device 19 is located downstream from the cleaning device (cleaning blade 13) in a rotating direction (a downstream side in a moving direction) of the photosensitive drum 3.

The lubricant supplying device 19 includes a layer-thinning blade 34 (a film-thinning blade, a lubricant film-thinning unit) on the downstream side in the rotating direction of the photosensitive drum 3 with respect to the brush-shaped rotating member 27 as a layer-thinning unit that thins the lubricant supplied onto the photosensitive drum 3. As with the cleaning blade 13, the layer-thinning blade 34 is a blade-shape member with a rubber member affixed to a metal supporting plate with an adhesive. As a material of the layer-thinning blade 34, polyurethane rubber, silicone rubber, nitrile rubber, chloroprene rubber, or the like can be used. Also, the layer-thinning blade 34 preferably has a modulus of elasticity of 20% to 80% and a thickness of 1 millimeter to 6 millimeters.

As explained above, with the lubricant supplying device 19 located downstream from the cleaning blade 13 in the rotating direction of the photosensitive drum 3, the transfer residual toner can be removed in advance by the cleaning blade 13 before applying the lubricant 25. Therefore, an influence on the surface potential of the photosensitive drum 3 due to entrance of the transfer residual toner in the lubricant supplying device 19 can be prevented. Furthermore, with the conductive brush 17 also disposed on a downstream side of the cleaning blade 13, abnormalities do not occur to the function of the conductive brush 17, and therefore the lubricant 25 can be stably applied.

In the third embodiment, the layer-thinning blade 34 is made contact in a counter direction with respect to the moving direction of the photosensitive drum 3 (a direction from the base portion of the blade to its tip is opposite to the rotating direction of the photosensitive drum 3). Alternatively, the layer-thinning blade 34 may be made contact with the photosensitive drum 3 in a trailing direction with respect to the moving direction of the photosensitive drum 3 (the direction from the base portion of the blade to its tip is the same as the rotating direction of the photosensitive drum 3).

As shown in FIG. 11, between the surface of the photosensitive drum 3 and a tip 34*a* of the layer-thinning blade 34, a nip portion 36 is formed with its width narrowed toward a rotating direction A of the photosensitive drum 3. Crawling into the nip portion 36, the lubricant 25 is thinned by pressure of the layer-thinning blade 34 (refer to a reference numeral 25*a* in the drawing). At this time, smaller powder of the lubricant 25 can be thinned to a molecule level on the surface of the photosensitive drum 3 by the layer-thinning blade 34. In the third embodiment, the powder lubricant 25 applied to the surface of the photosensitive drum 3 is thinned, and spread all over the surface 4 of the photosensitive drum 3 to increase the lubricating property.

In the third embodiment, the charging device (charging unit) 5 is arranged to be opposed to the photosensitive drum 3 in a non-contact manner. With this, an inconvenience can be suppressed in which the lubricant supplied to the photosensitive drum 3 is attached to the charging device 5.

As explained above, according to the third embodiment, as with each embodiment explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 12:
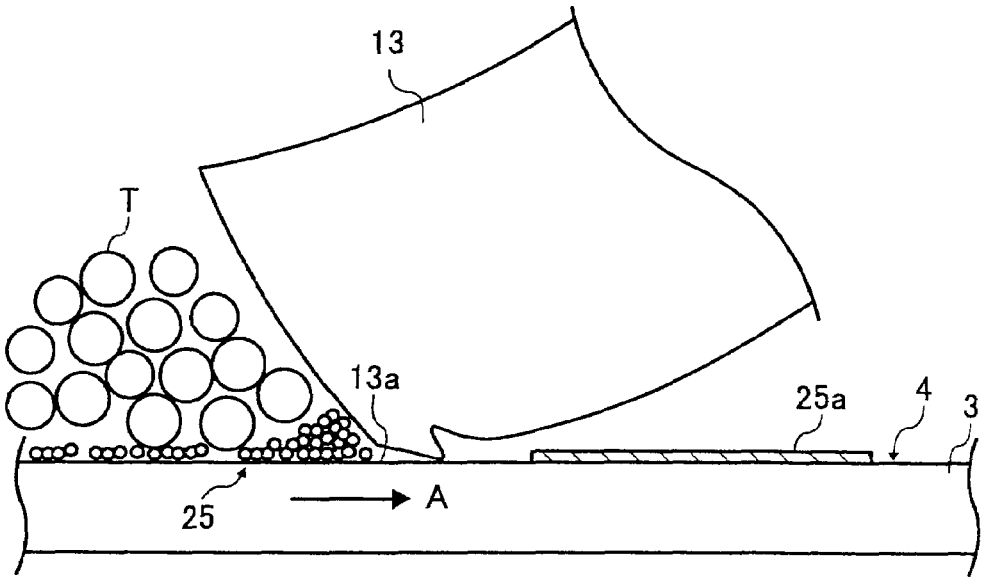
FIG. 12 is an enlarged view of relevant part of a cleaning device according to a fourth embodiment of the present invention.

FIG. 12 is an enlarged view of relevant part of a cleaning device according to a fourth embodiment of the present invention. In the fourth embodiment, the cleaning blade of the cleaning device functions as a layer-thinning blade.

In the fourth embodiment, the lubricant supplying device 19 is internally provided to the cleaning device (such configuration is similar to that of the first embodiment). The cleaning blade 13 of the cleaning device functions as a layer-thinning blade (layer-thinning unit). That is, the powder lubricant 25 flying on the surface of the photosensitive drum 3 is thinned by the cleaning blade 13.

As shown in FIG. 12, when the cleaning blade 13 is used as a layer-thinning unit, the transfer residual toner T to be cleaned is mixed with the powder lubricant 25 at a nip portion 13*a*. However, since particles of the powder lubricant 25 are significantly smaller than particles of the toner T, the particles of the lubricant 25 deeply enter the nip portion 13*a* and are hardly influenced by the transfer residual toner T. As such, the powder lubricant 25 attached on the surface 4 can be thinned by the cleaning blade 13. Therefore, no additional layer-thinning blade is required separately from the cleaning blade 13, which reduces the number of components and downsizing the image forming apparatus.

As explained above, according to the fourth embodiment, as with each embodiment explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 13:
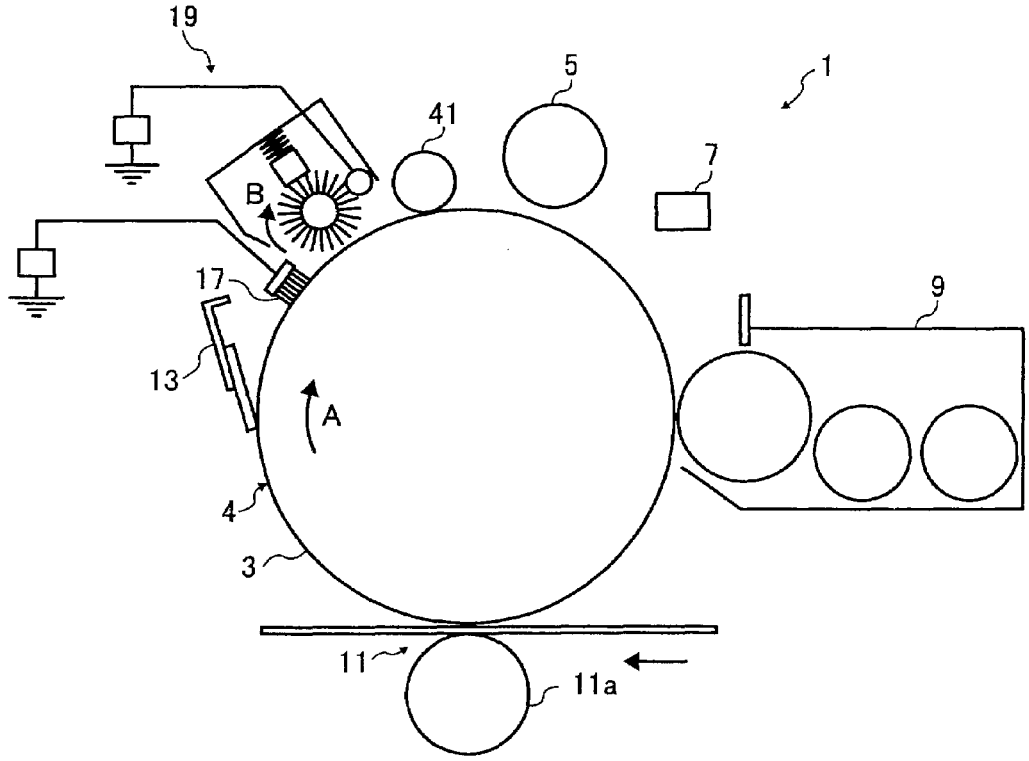
FIG. 13 is a schematic of an image forming apparatus according to a fifth embodiment of the present invention.

FIG. 13 is a schematic of an image forming apparatus according to a fifth embodiment of the present invention. In the fifth embodiment, a roller-shaped rotating member is used as a thinning unit differently from the first embodiment in which a blade-shaped member is used as a thinning unit.

With reference to FIG. 13, as with the third embodiment, the lubricant supplying device 19 is also located downstream from the cleaning device in the rotating direction of the photosensitive drum 3.

As a layer-thinning unit, a layer-thinning roller 41 (a rotational roller, an elastic roller) is set up. The layer-thinning roller 41 is made of rubber material, and is a roller-shaped rotating member abutting on the photosensitive drum 3.

Figure 14:
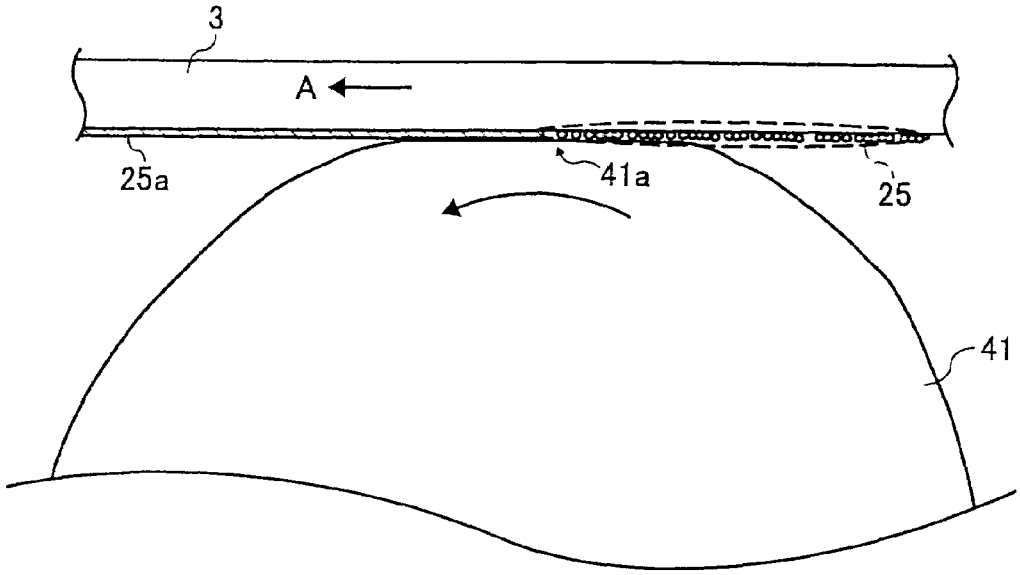
FIG. 14 is an enlarged view of a layer-thinning roller in a lubricant supplying device shown in FIG. 13.

FIG. 14 is an enlarged view of a nip portion 41*a* between the layer-thinning roller 41 and the photosensitive drum 3. The lubricant 25 crawls into the nip portion 41*a* formed between the layer-thinning roller 41 and the photosensitive drum 3, and is then thinned (layered) by the pressure between the layer-thinning roller 41 and the photosensitive drum 3. In the fifth embodiment, the layer-thinning roller 41 is made of rubber material. With this, a large contact width (nip width) between the layer-thinning roller 41 and the photosensitive drum 3 is formed through elastic deformation of the layer-thinning roller 41. Furthermore, with the layer-thinning roller 41 rotating with a difference in linear velocity from the photosensitive drum, a shearing force is exerted on the lubricant at the nip portion 41*a*, and thinning of the lubricant 25 can be easier.

As explained above, according to the fifth embodiment, as with each of the embodiments explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 15:
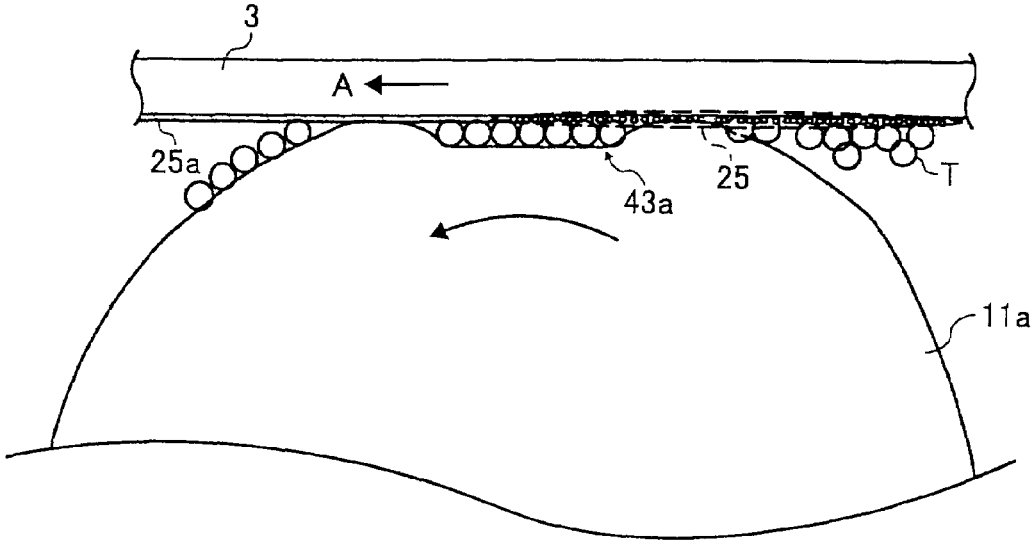
FIG. 15 is an enlarged view of relevant part of a transferring device according to a sixth embodiment of the present invention.

FIG. 15 is a schematic of a transferring device according to a sixth embodiment of the present invention. The sixth embodiment is different from the fifth embodiment in that a transfer roller is used as a roller-shaped rotating member.

In the sixth embodiment, the transfer roller 11*a* is used as a layer-thinning unit (roller-shaped rotating member). FIG. 15 depicts an enlarged view around a nip portion 43*a* when the transfer roller 11*a* is used as a layer-thinning unit. In the sixth embodiment, the transfer toner T is mixed with the powder lubricant 25 at the nip portion 43*a*. However, the nip portion 43*a* of the transfer roller 11*a* is larger in width than the nip portion 13*a* of the cleaning blade 13, and therefore particles of the powder lubricant 25 are thinned almost without receiving an influence of the toner. In the sixth embodiment, because of thinning the lubricant 25 by the transfer roller 11*a*, no additional roller-shaped rotating member (a thinning unit) is required separately from the transfer roller 11*a*, which reduces the number of components.

As explained above, according to the sixth embodiment, as with each embodiment explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 16:
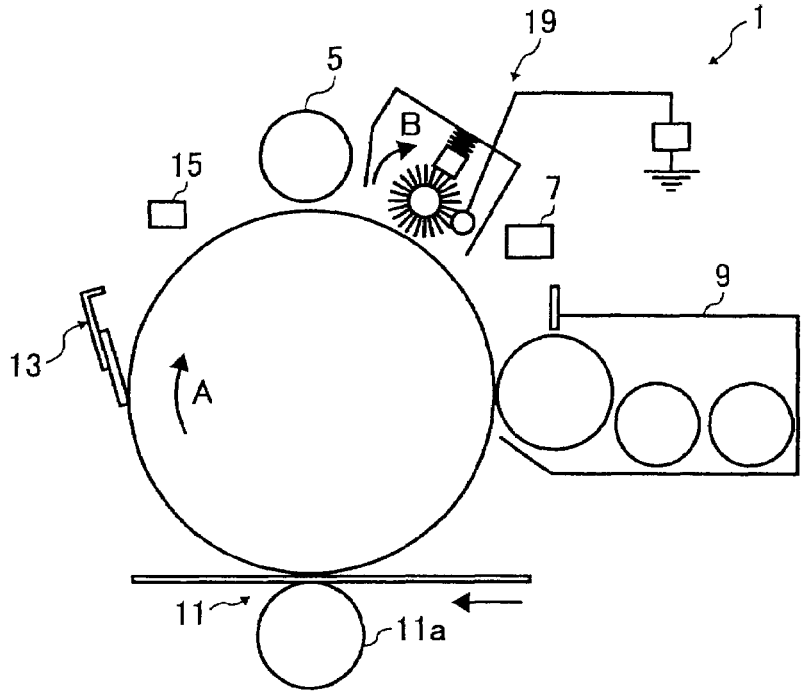
FIG. 16 is a schematic of an image forming apparatus according to a seventh embodiment of the present invention.

FIG. 16 is a schematic of an image forming apparatus according to a seventh embodiment of the present invention. The seventh embodiment is different from the first embodiment in that the charging device 5 is used as a surface potential equalizing unit.

As shown in FIG. 16, the lubricant supplying device 19 is disposed on a downstream side of the charging device 5 (on the downstream side in the rotating direction of the photosensitive drum 3). With the lubricant supplying device 19 disposed on the downstream side of the charging device 5, the surface potential of the photosensitive drum 3 is equalized before supplying the lubricant. Therefore, no additional surface potential equalizing unit is required. Thus, the number of components can be reduced, and the image forming apparatus can be downsized.

Also, in the seventh embodiment, the lubricant 25 is supplied onto the surface of the photosensitive drum 3 by the lubricant supplying device 19 when the photosensitive drum 3 does not form an image. With this, an influence of the exposing device 7 can be prevented when the lubricant is supplied to the photosensitive drum 3. That is, after the lubricant 25 is supplied onto the surface 4 uniformly charged by the charging device 5, no electrostatic latent image is formed by the exposing device 7. Therefore, the lubricant 25 attached to the photosensitive drum 3 can be prevented from being away from the surface of the photosensitive drum by an application of a developing bias to flow into the developing device 9. Thus, the state can be kept in which the lubricant 25 is uniformly attached onto the photosensitive drum surface. In this case, the lubricant 25 attached on the photosensitive drum 3 is thinned by the transfer roller 11*a*.

As explained above, according to the seventh embodiment, as with each of the embodiments explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 17:
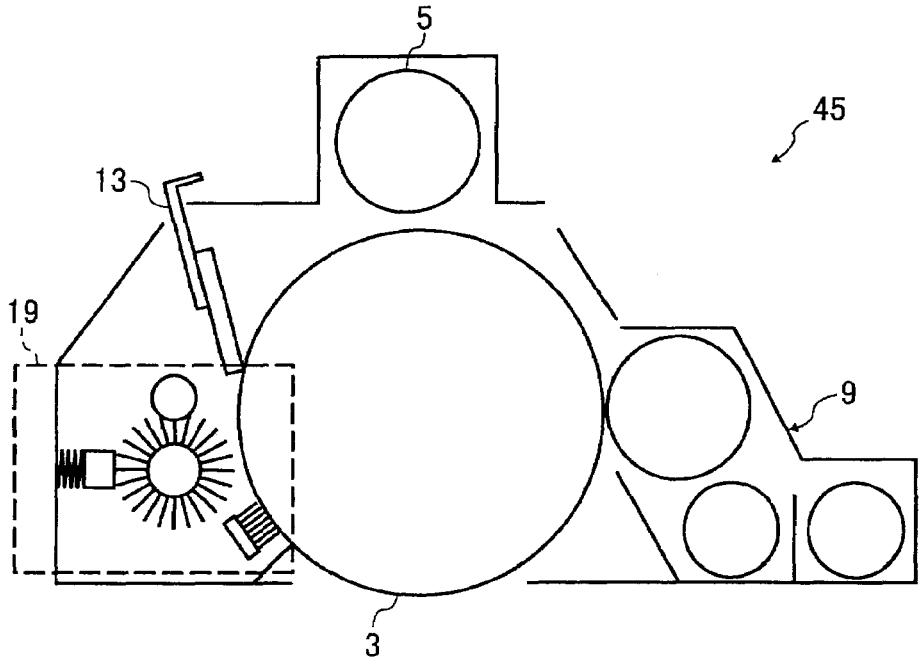
FIG. 17 is a schematic of a process cartridge according to an eighth embodiment of the present invention.

FIG. 17 is a schematic of a process cartridge according to an eighth embodiment of the present invention. The eighth embodiment is different from the first embodiment in that a lubricant supplying device is provided to a process cartridge.

As shown in FIG. 17, the photosensitive drum 3, the charging device 5, the developing device 9, the cleaning device 13, and the lubricant supplying device 19 explained in the first embodiment are integrally formed as a process cartridge 45.

Generally, spherical toner has a transfer efficiency higher than that of grinded toner, and has a small amount of transfer residual toner. Therefore, a container collecting waste toner collected by the cleaning blade 13 can be small. By contrast, in a process cartridge in which only a small-size cleaning blade can be incorporated due to restrictions in space, defective cleaning tends to occur.

In the eighth embodiment, the lubricant supplying device 19 is incorporated in the process cartridge 45 to increase cleaning capability. Also, even when spherical toner in which defective cleaning tends to occur is used, the residual toner can be reliably cleaned. Also, with the use of the spherical toner, the space for storing waste toner in the process cartridge 45 can be decreased, and the compact process cartridge 45 can be realized.

Also, with the photosensitive drum 3, the charging device 5, the developing device 9, the cleaning device 13, and the lubricant supplying device 19 being integrally supported as the process cartridge 45, its replacement is easy, which increases convenience.

As explained above, according to the eighth embodiment, as with each of the embodiments explained above, the brush-shaped rotating member 27 carrying the lubricant is opposed to the photosensitive drum 3 in a non-contact manner, and the lubricant carried by the brush-shaped rotating member 27 is electrically transferred onto the photosensitive drum 3. With this, the surface of the photosensitive drum 3 tends not to suffer flaws, an appropriate amount of the lubricant can be uniformly and stably supplied onto the photosensitive drum 3, and flexibility in layout of the device can be increased.

Figure 18:
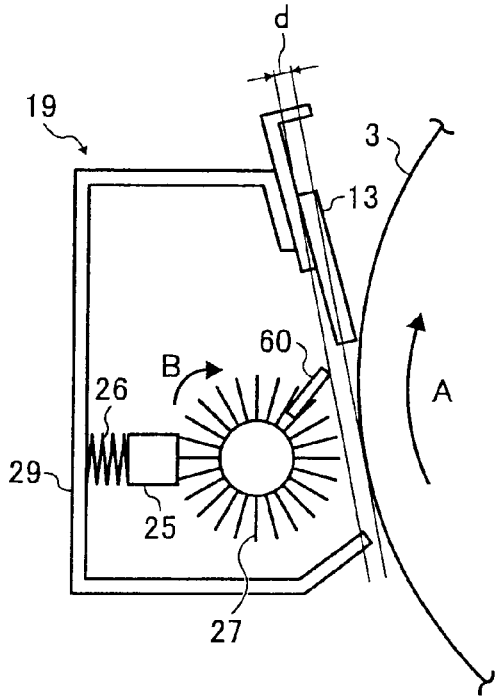
FIG. 18 is a schematic of a lubricant supplying device according to a ninth embodiment of the present invention.
Figure 19:
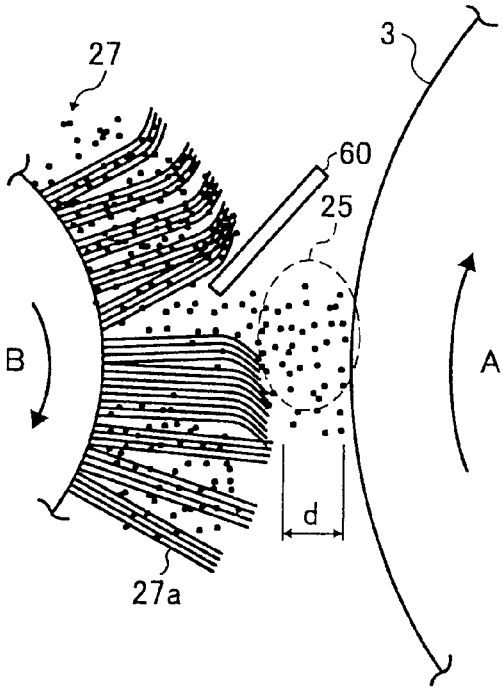
FIG. 19 is an enlarged view of a portion near a brush-shaped rotating member shown in FIG. 18.

FIG. 18 is a schematic of a lubricant supplying device according to a ninth embodiment of the present invention. FIG. 19 is an enlarged view of a portion near a brush-shaped rotating member in the lubricant supplying device of FIG. 18. The eighth embodiment is different from the embodiments explained above in that a plate-shaped member is used as a transfer unit.

As shown in FIGS. 18 and 19, as with the first embodiment, the brush-shaped rotating member 27 as a lubricant carrying unit is disposed to be opposed to the photosensitive drum 3 in a non-contact manner with a gap "d".

In the ninth embodiment, a flicker 60 that slidably contacts brush bristles of the brush-shaped rotating member 27 is used as a transfer unit that transfers the lubricant carried by the brush-shaped rotating member 27 onto the photosensitive drum 3. The flicker 60 is a plate-shaped member made of stainless or the like, and is arranged to engage in the brush bristles toward the rotation center of the brush-shaped rotating member 27. The flicker 60 is disposed on an upstream side in the rotating direction of the brush-shaped rotating member 27 with respect to a position where the brush-shaped rotating member 27 and the photosensitive drum 3 are opposed to each other.

With such a configuration, with reference to FIG. 19, brush bristles 27*a* of the brush-shaped rotating member 27 are bent (deformed) in a direction in reverse to a direction indicated by an arrow B at the position of the flicker 60, and then passes through the position of the flicker 60 to abruptly restore (stand up). When the brush bristles 27*a* restore, a pressure force occurs, and then the lubricant carried by the brush-shaped rotating member 27 flies (this is represented by the lubricant 25 surrounded by dotted line in FIG. 19) to transfer (be supplied) onto the photosensitive drum 3.

The amount of engagement of the flicker 60 (transfer unit) with the brush bristles 27*a* is defined so that the lubricant reliably flies to the photosensitive drum 3, based on the length and the degree of buckling and recovery of the brush bristles 27*a*. If the amount of engagement of the flicker 60 is too large, the amount of falling of the brush bristles 27*a* is increased, which causes the brush bristles 27*a* to quickly deteriorate.

Also, the gap "d" between the brush-shaped rotating member 27 and the photosensitive drum 3 is preferably within a range of 0.5 millimeters to 5.0 millimeters. If the gap "d" exceeds 5.0 millimeters, even if the lubricant flies due to a repulsive force (pressure force) of the brush bristles 27*a*, an airflow occurring between the brush-shaped rotating member 27 and the photosensitive drum 3 may prevent the lubricant from reaching on the surface of the photosensitive drum 3.

As explained above, according to the ninth embodiment, the brush-shaped rotating member 27 (lubricant carrying unit) carrying the lubricant is opposed to the photosensitive drum 3 (image carrier) in a non-contact manner, and the lubricant carried by the brush-shaped rotating member 27 is mechanically transferred onto the photosensitive drum 3 by using the flicker 60. With this, the surface of the photosensitive drum 3 tends not to suffer flaws, an appropriate amount of the lubricant can be uniformly and stably supplied onto the photosensitive drum 3, and flexibility in layout of the device can be increased.

Figure 20:
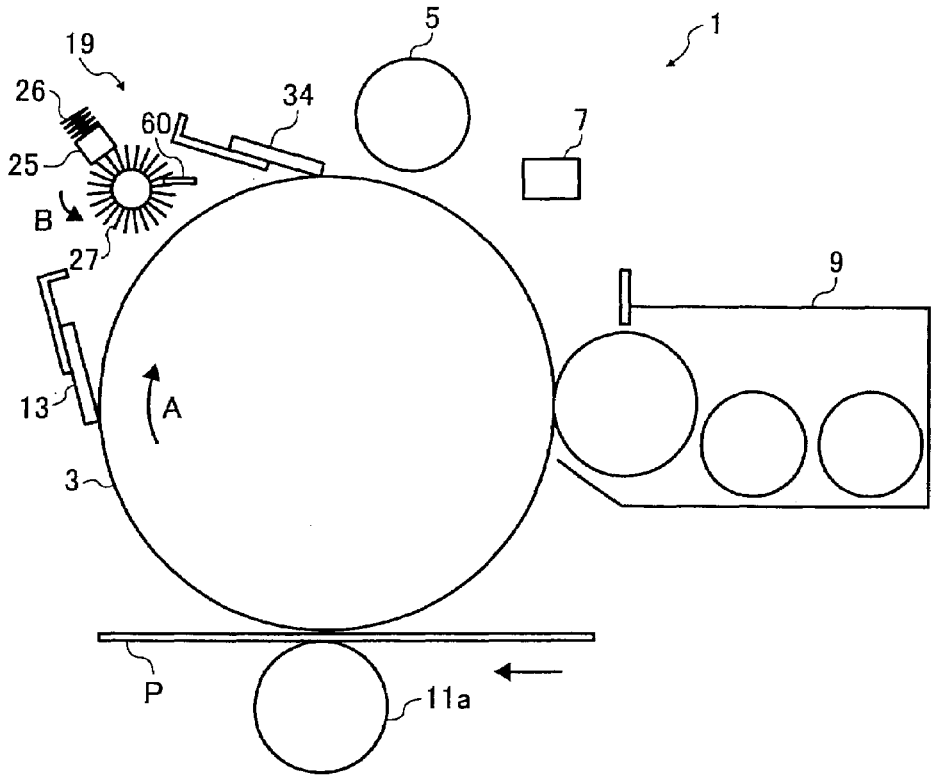
FIG. 20 is a schematic of an image forming apparatus according to a tenth embodiment of the present invention.

FIG. 20 is a schematic of an image forming apparatus according to a tenth embodiment of the present invention. In the tenth embodiment, a lubricant supplying device is provided separately from a cleaning device differently from the ninth embodiment in which a lubricant supplying device is internally provided to the cleaning device.

Also, in the lubricant supplying device 19 according to the tenth embodiment, as with the ninth embodiment, the flicker 60 (plate-shaped member) is used as a transfer unit that causes the lubricant carried by the non-contact brush-shaped rotating member 27 to fly onto the photosensitive drum 3.

As with the third embodiment, the lubricant supplying device 19 according to the tenth embodiment is located downstream from the cleaning device (cleaning blade 13) in the rotating direction of the photosensitive drum 3. Also, the lubricant supplying device 19 is provided with the layer-thinning blade 34 as a layer-thinning unit on a downstream side of the brush-shaped rotating member 27.

The present inventors performed a running test by using the lubricant supplying device 19 (image forming apparatus) according to the tenth embodiment.

In the lubricant supplying device 19, the gap "d" was set at 1.0 millimeter, the length of the brush bristles 27*a* was set at 5 millimeters, a brush density was set at 0.1 million per square inch, a brush resistance was set at $10^5$ Ω·cm, the amount of engagement of the flicker 60 was set at 1.0 millimeter, and the rotating speed of the brush-shaped rotating member 27 was set equal to the speed of the photosensitive drum 3. Also, in the running test, a transfer material P of A4 size was conveyed so that its short-hand direction was a conveying direction, and hundred thousand transfer materials each having formed thereon a horizontal-band solid image with an image area ratio of 5% were output. The coefficient of friction on the surface of the photosensitive drum, cleaning ability, and a film scraping amount of the photosensitive drum were checked for every five thousand, ten thousand, twenty thousand, fifty thousand, eighty thousand, and hundred thousand materials.

As a result, for five thousand output materials, the coefficient of friction on the surface of the photosensitive drum was 0.18, the cleaning ability was good, and the film scraping amount of the photosensitive drum was 0.2 micrometers. For ten thousand output materials, the coefficient of friction on the surface of the photosensitive drum was 0.19, the cleaning ability was good, and the film scraping amount of the photosensitive drum was 0.4 micrometers. For twenty thousand output materials, the coefficient of friction on the surface of the photosensitive drum was 0.20, the cleaning ability was good, and the film scraping amount of the photosensitive drum was 0.7 micrometers. For fifty thousand output materials, the coefficient of friction on the surface of the photosensitive drum was 0.20, the cleaning ability was good, and the film scraping amount of the photosensitive drum was 1.8 micrometers. For eighty thousand output materials, the coefficient of friction on the surface of the photosensitive drum was 0.18, the cleaning ability was good, and the film scraping amount of the photosensitive drum 3 was 3.1 micrometers. For hundred thousand output materials, the coefficient of friction on the surface of the photosensitive drum was 0.21, the cleaning ability was good, and the film scraping amount of the photosensitive drum was 4.1 micrometers.

As such, the coefficient of friction of the photosensitive drum was stable at low values even with time. Therefore, it can be found that the lubricant was sufficiently supplied onto the photosensitive drum. Also, it can be found that good cleaning ability was kept without the occurrence of defective cleaning. Furthermore, it can be found that the film scraping amount of the photosensitive drum was at a level without problem.

As explained above, according to the tenth embodiment, as with the ninth embodiment, the brush-shaped rotating member 27 carrying the lubricant is opposed to the photosensitive drum 3 in a non-contact manner, and the lubricant carried by the brush-shaped rotating member 27 is mechanically transferred onto the photosensitive drum 3 by using the flicker 60. With this, the surface of the photosensitive drum 3 tends not to suffer flaws, an appropriate amount of the lubricant can be uniformly and stably supplied onto the photosensitive drum 3, and flexibility in layout of the device can be increased.

Incidentally, the constituent elements described above and shown in the drawings are merely conceptual, and need not be physically configured as illustrated. Any number, position, shape, and the like of the constituent elements can be adopted as suitable for implementation of the present invention.

As set forth hereinabove, according to the preset invention, a lubricant carrying unit that carries lubricant is opposed to an image carrier in a non-contact manner, and therefore, the lubricant is actively transferred onto the image carrier without free-falling. With this, the surface of the image carrier can be resistant to flaws, and an appropriate amount of lubricant can be evenly and stably supplied to the image carrier. Thus, a lubricant supplying device, a cleaning device, a process cartridge, and an image forming apparatus with high flexibility in layout can be provided.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lubricant supplying device that supplies lubricant onto an image carrier, the lubricant supplying device comprising:

a carrying unit that faces the image carrier in a non-contact manner, and carries the lubricant; and a transfer unit that transfers the lubricant from the carrying unit onto the image carrier;

a thinning unit that is located downstream from the carrying unit in a moving direction of the image carrier, and thins the lubricant on the image carrier, wherein the thinning unit is a roller-shaped rotating member that abuts the image carrier.

2. A lubricant supplying device that supplies lubricant onto an image carrier, the lubricant supplying device comprising:

a carrying unit that faces the image carrier in a non-contact manner, and carries the lubricant;

a potential equalizing unit that is located upstream from the carrying unit in a moving direction of the image carrier, and equalizes a surface potential of the image carrier; and a transfer unit that transfers the lubricant from the carrying unit onto the image carrier, wherein the transfer unit forms an electric field between the image carrier and the carrying unit, and charges the lubricant carried by the carrying unit to transfer the lubricant to the image carrier by the electric field.

3. The lubricant supplying device according to claim 2, wherein the carrying unit is located at a position where the lubricant does not drop by self weight onto the image carrier.

4. The lubricant supplying device according to claim 2, wherein:

the carrying unit is a brush-shaped rotating member that includes conductive brush bristles, and the transfer unit charges the lubricant via an electrode that contacts the brush bristles.

5. The lubricant supplying device according to claim 2, wherein the potential equalizing unit is a conductive brush that slidably contacts the image carrier.

6. The lubricant supplying device according to claim 2, wherein the potential equalizing unit includes:

a charging unit that charges a surface of the image carrier to a predetermined potential; and a static eliminating unit that emits static-eliminating light onto the image carrier charged to the predetermined potential.

7. The lubricant supplying device according to claim 2, wherein the carrying unit is a brush-shaped rotating member that includes brush bristles, and the transfer unit deforms the brush bristles such that restoring force of the brush bristles causes the lubricant to fly toward the image carrier.

8. The lubricant supplying device according to claim 7, wherein the transfer unit is a plate-shaped member that slidably contacts the brush bristles.

9. The lubricant supplying device according to claim 2, further comprising a thinning unit that is located downstream from the carrying unit in a moving direction of the image carrier, and thins the lubricant on the image carrier.

10. The lubricant supplying device according to claim 9, wherein the thinning unit is a blade-shaped member that abuts the image carrier.

11. The lubricant supplying device according to claim 2, located in a cleaning device that cleans a surface of the image carrier.

12. The lubricant supplying device according to claim 2, located downstream, in a moving direction of the image carrier, from a cleaning device that cleans a surface of the image carrier.

13. The lubricant supplying device according to claim 2, wherein the transfer unit transfers the lubricant onto the image carrier when the image carrier is being driven.

14. The lubricant supplying device according to claim 2, wherein the transfer unit transfers the lubricant onto the image carrier at predetermined time intervals.

15. The lubricant supplying device according to claim 2, wherein the lubricant is zinc stearate.

16. A cleaning device that cleans a surface of an image carrier, the cleaning device comprising:

the lubricant supplying device according to claim 2.

17. A process cartridge that is detachably mounted on an image forming apparatus, the process cartridge comprising:

the lubricant supplying device according to claim 2 that is integrally formed with an image carrier.

18. An image forming apparatus comprising:

the lubricant supplying device according to claim 2; and an image carrier.

* * * * *